US012313328B2

(12) United States Patent
Romero et al.

(10) Patent No.: US 12,313,328 B2
(45) Date of Patent: May 27, 2025

(54) CONDENSATE COLLECTION ASSEMBLY

(71) Applicant: Johnson Controls Tyco IP Holdings LLP, Milwaukee, WI (US)

(72) Inventors: Elmer Wayne Romero, Oxford, KS (US); Xianjin Cheng, Andover, KS (US); Stephen C. Szczepanski, Wichita, KS (US); Cole B. Morrow, Derby, KS (US); Satish V. Churi, Gadag (IN)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 15 days.

(21) Appl. No.: 17/733,628

(22) Filed: Apr. 29, 2022

(65) Prior Publication Data

US 2022/0349645 A1 Nov. 3, 2022

Related U.S. Application Data

(60) Provisional application No. 63/182,377, filed on Apr. 30, 2021.

(51) Int. Cl.
*F25D 21/14* (2006.01)

(52) U.S. Cl.
CPC ..... *F25D 21/14* (2013.01)

(58) Field of Classification Search
CPC ..... F25D 21/14; F24F 1/36
See application file for complete search history.

(56) References Cited

U.S. PATENT DOCUMENTS 5,904,053 A * 5/1999 Polk ..... F25D 21/14 62/286
5,987,909 A * 11/1999 Martin, Sr. ..... F24F 13/222 62/291
2020/0064054 A1* 2/2020 Carlton ..... F28F 17/005

* cited by examiner

*Primary Examiner* — Elizabeth J Martin
*Assistant Examiner* — Samba Gaye
(74) *Attorney, Agent, or Firm* — Fletcher Yoder, P.C.

(57) ABSTRACT

A heating, ventilation, and/or air conditioning (HVAC) system includes a condensate collection assembly having a drain pan configured to collect condensate generated by a heat exchanger of the HVAC system. The condensate collection assembly also includes a support member configured to couple to the drain pan and extend from the drain pan. Further, the condensate collection assembly includes a shield panel configured to couple to the support member and overlap with the heat exchanger relative to a direction of air flow across the heat exchanger.

20 Claims, 9 Drawing Sheets

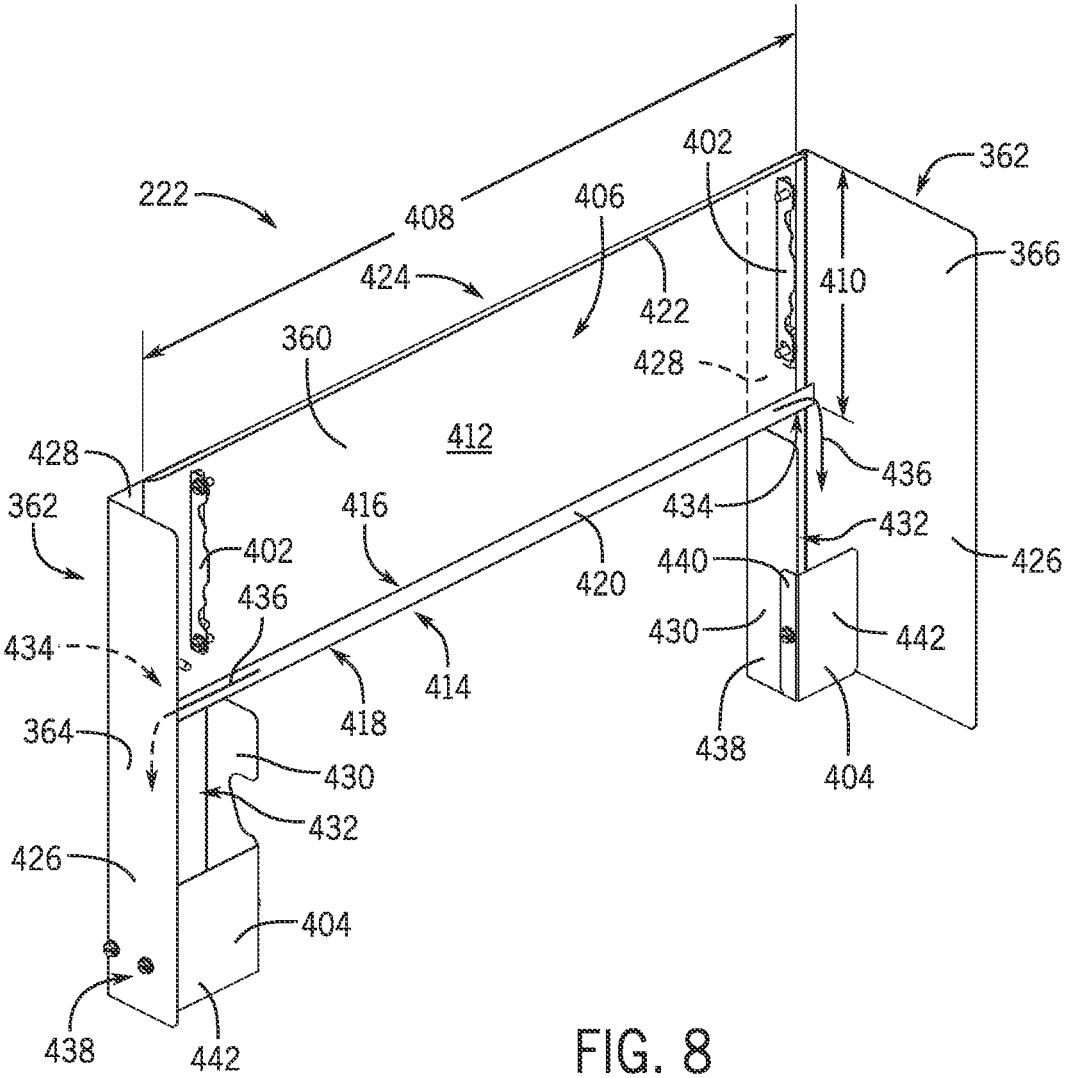
FIG. 8
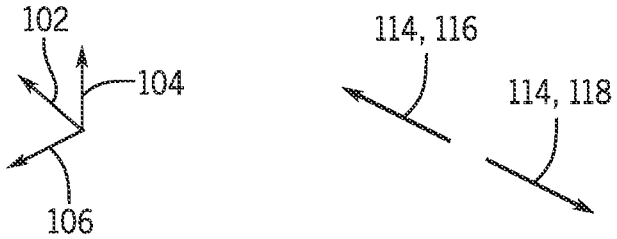

CONDENSATE COLLECTION ASSEMBLY

CROSS REFERENCE TO RELATED APPLICATION

This application claims priority from and the benefit of U.S. Provisional Application No. 63/182,377, entitled "AN HVAC UNIT," filed Apr. 30, 2021, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties through control of an air flow delivered to the environment. In some cases, environmental control systems include a vapor compression system, which includes heat exchangers, such as a condenser and an evaporator, that transfer thermal energy between the vapor compression system and the environment. Fans or blowers may direct a flow of supply air across a heat exchange area of the evaporator, and refrigerant circulating through the evaporator may absorb thermal energy from the supply air. Accordingly, the evaporator may discharge conditioned air, which is subsequently directed toward a cooling load, such as an interior of a building. In some instances, the evaporator may condense moisture suspended within the supply air, and a condensate may be formed on an exterior surface of the evaporator. The condensate is generally directed to a drain pan configured to collect the condensate generated by the evaporator. However, the air flow passing across the evaporator may displace condensate formed and/or accumulated on the evaporator. Unfortunately, the velocity of the air flow may transfer the displaced condensate to a location or region beyond the drain pan.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present invention relates to a condensate collection assembly. The condensate collection assembly includes a drain pan configured to collect condensate generated by a heat exchanger of a heating, ventilation, and air conditioning (HVAC) system. The condensate collection assembly also includes a support member configured to couple to the drain pan and extend from the drain pan. Further, the condensate collection assembly includes a shield panel configured to couple to the support member and overlap with the heat exchanger relative to a direction of air flow across the heat exchanger.

The present invention also relates to a condensate collection assembly comprising a drain pan configured to collect condensate generated by a heat exchanger disposed within an air flow path of an HVAC system. The condensate collection assembly also includes a condensate capture assembly. Further, the condensate capture assembly includes a support member configured to couple to the drain pan and a condensate barrier configured to couple to the support member. The condensate barrier is coupled to the support member such that it is disposed within the air flow path and is offset from the drain pan.

The present invention further relates to an HVAC system that includes a heat exchanger disposed within an airflow path and configured to condition an air flow directed across the heat exchanger. The HVAC system also includes a condensate collection assembly configured to capture condensate generated by the heat exchanger. The condensate collection assembly includes a drain pan disposed beneath the heat exchanger and a shield panel. The shield panel extends across the air flow path and is configured to capture condensate generated by the heat exchanger, directing the condensate towards the drain pan. In addition, the shield panel is configured to overlap with the heat exchanger relative to a direction of air flow along the air flow path. The shield panel is also configured to be separate and offset from the drain pan.

BRIEF DESCRIPTION OF DRAWINGS

Various aspects of this disclosure may be better understood upon reading the following detailed description and upon reference to the drawings in which:

FIG. 8 is a perspective view of an embodiment of components of a condensate collection assembly, in accordance with an aspect of the present disclosure.

DETAILED DESCRIPTION

Figure 1:
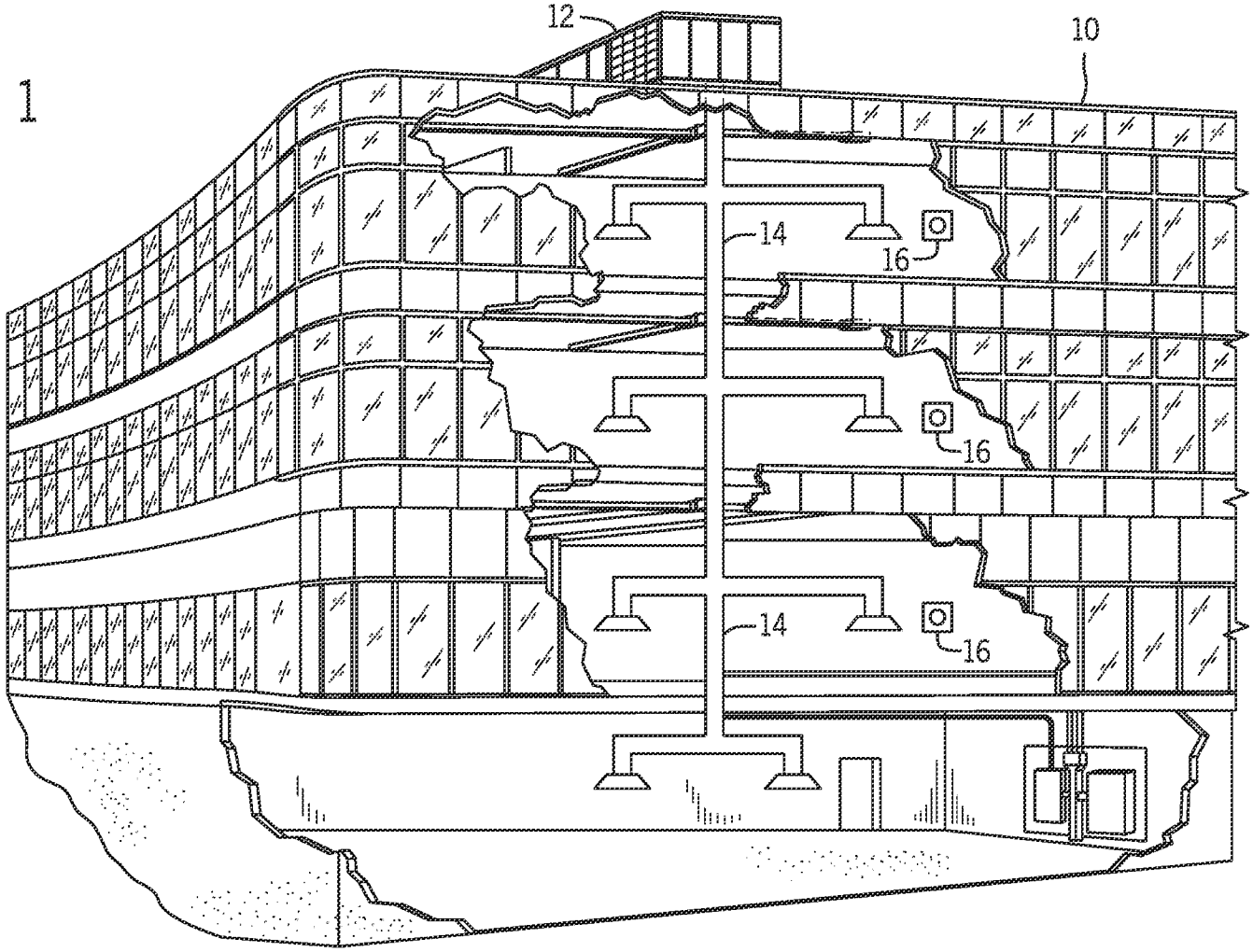
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a heat transfer fluid (e.g., a working fluid), such as a refrigerant, and a fluid to be conditioned, such as air. The vapor compression system includes heat exchangers (e.g. a condenser, an evaporator) that are fluidly coupled to one another via one or more conduits to form a refrigerant circuit. A compressor may be used to circulate the refrigerant through the refrigerant circuit and enable the transfer of thermal energy between components of the vapor compression system (e.g., the condenser, the evaporator) and one or more thermal loads (e.g., an environmental air flow, a supply air flow).

Generally, one or more heat exchangers of the HVAC system may operate to condition a flow of air that is supplied to a conditioned space, such as interior of a building. The air to be conditioned may include ambient (e.g., outside) air, return air, a mixture of ambient air and return air, and/or another suitable flow of air. The HVAC system may include one or more fans or blowers that direct a flow of air across a heat exchange area of a heat exchanger to enable conditioning (e.g., heating, cooling, dehumidification) of the air. For example, an evaporator of the HVAC system may be configured to place refrigerant circulating through the evaporator in a heat exchange relationship with the air flow. In this way, the refrigerant within the evaporator may absorb thermal energy from the air flow, thereby cooling the air flow before the air flow is discharged toward a conditioned space as a supply air flow.

Cooling of the air flow via the evaporator may cause moisture suspended within the air flow to condense, thereby forming condensate. In certain instances, condensate generated via the evaporator may initially collect on the heat exchange area of the evaporator. Condensate formed and/or accumulated on the evaporator may fall (e.g., via force of gravity) toward a drain pan positioned vertically beneath the evaporator. The drain pan may collect the condensate that falls from the evaporator and direct the condensate toward a drain or other suitable discharge outlet. Unfortunately, in some applications, the evaporator may be arranged (e.g., positioned, oriented) in a manner that reduces the effectiveness of conventional drain pans.

For example, in some cases an HVAC system or HVAC unit having an evaporator may be arranged to direct an air flow across the evaporator in a generally lateral direction, such as either left to right or right to left. An air flow directed across the evaporator may cause condensate formed and/or accumulated thereon to become dislodged from the evaporator. More specifically, the air flow may dislodge the condensate from the evaporator and displace or carry the condensate in a direction (e.g., lateral direction) of the air flow. Moreover, increased turbulence and/or velocity of the air flow may cause the dislodged condensate to travel away from the evaporator (e.g., in a direction of the air flow). Condensate carried by the air flow may not fall, via force of gravity, into the drain pan positioned beneath the evaporator, which may result in the condensate permeating areas or regions external to the drain pan and/or HVAC unit. Therefore, it is now recognized that improved condensate collection systems are desirable for HVAC systems.

Accordingly, embodiments of the present disclosure are directed to an improved condensate collection assembly that enables improved capture of condensate formed during operation of an HVAC system. For example, the condensate collection assembly may include one or more components configured to enable capture of condensate that may be susceptible to lateral discharge from an evaporator via an air flow directed across the evaporator in a lateral (e.g., horizontal, sideways) direction. As described in further detail below, the condensate collection assembly may include a drain pan and one or more panels (e.g., a shield panel) that may be suspended from the drain pan by one or more support members. The shield panel may be positioned on a lateral side (e.g., laterally adjacent) to the evaporator and may be configured to block discharge of condensate in an outward (e.g., laterally outward) direction. In particular, the shield panel may block discharge of condensate from a region or area generally defined by a perimeter of the drain pan. Additionally, condensate blocked or captured by the shield panel may be directed by the condensate collection assembly toward the drain pan for collection and discharge in a suitable manner. In this way, present embodiments enable improved capture and collection of condensate generated during operation of the HVAC system. Additional details and benefits enabled by the present embodiments are described in further detail below.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
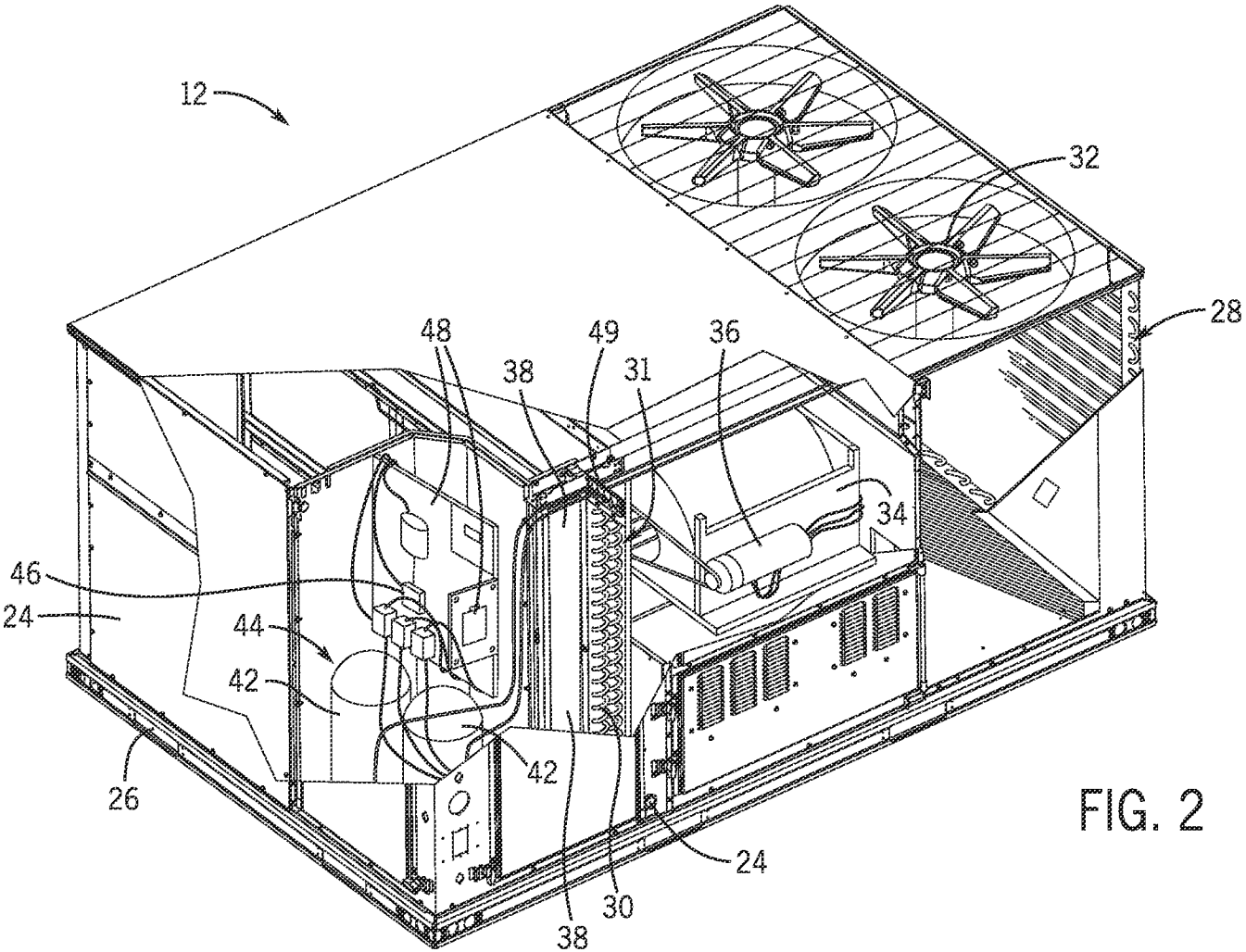
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10.

While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
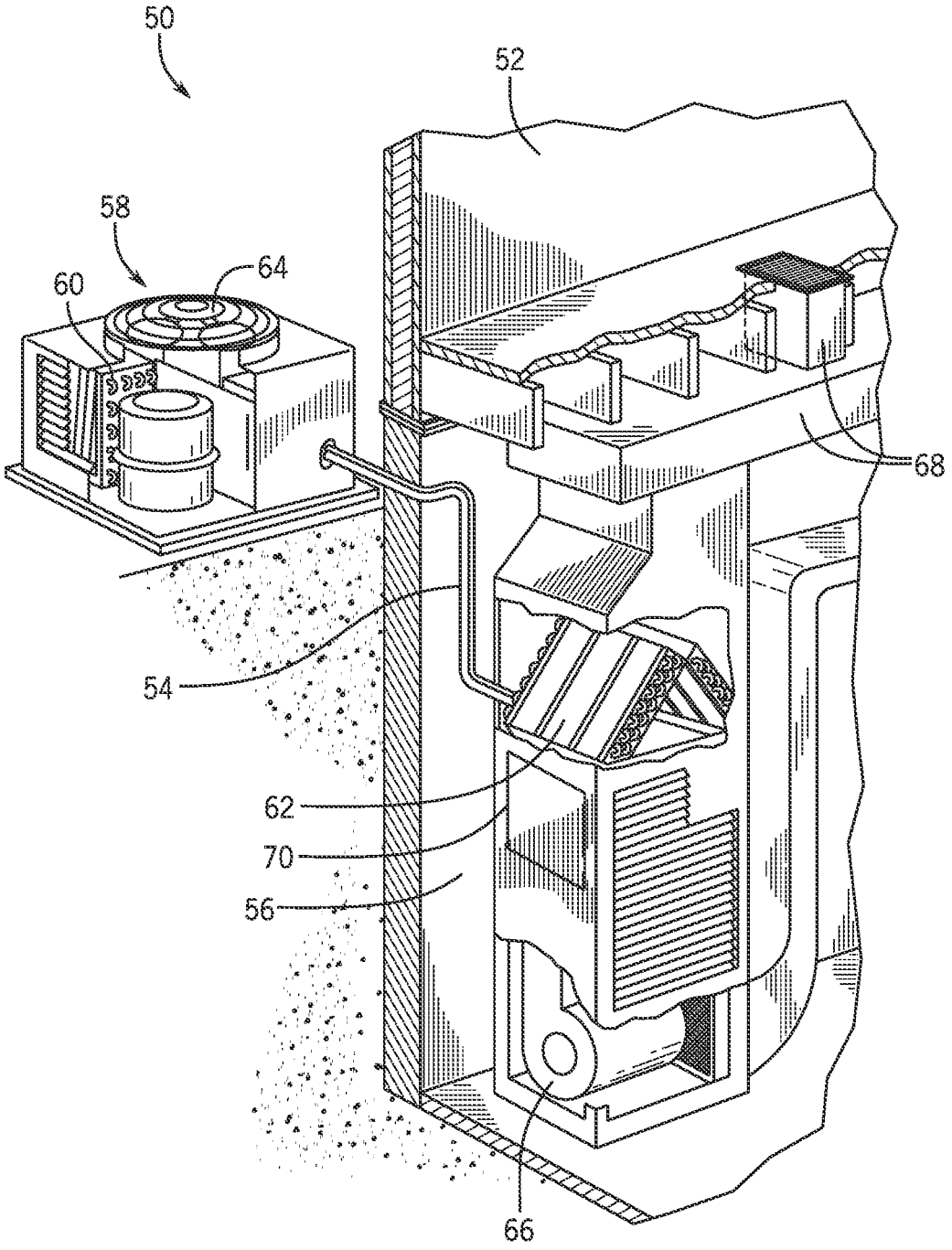
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
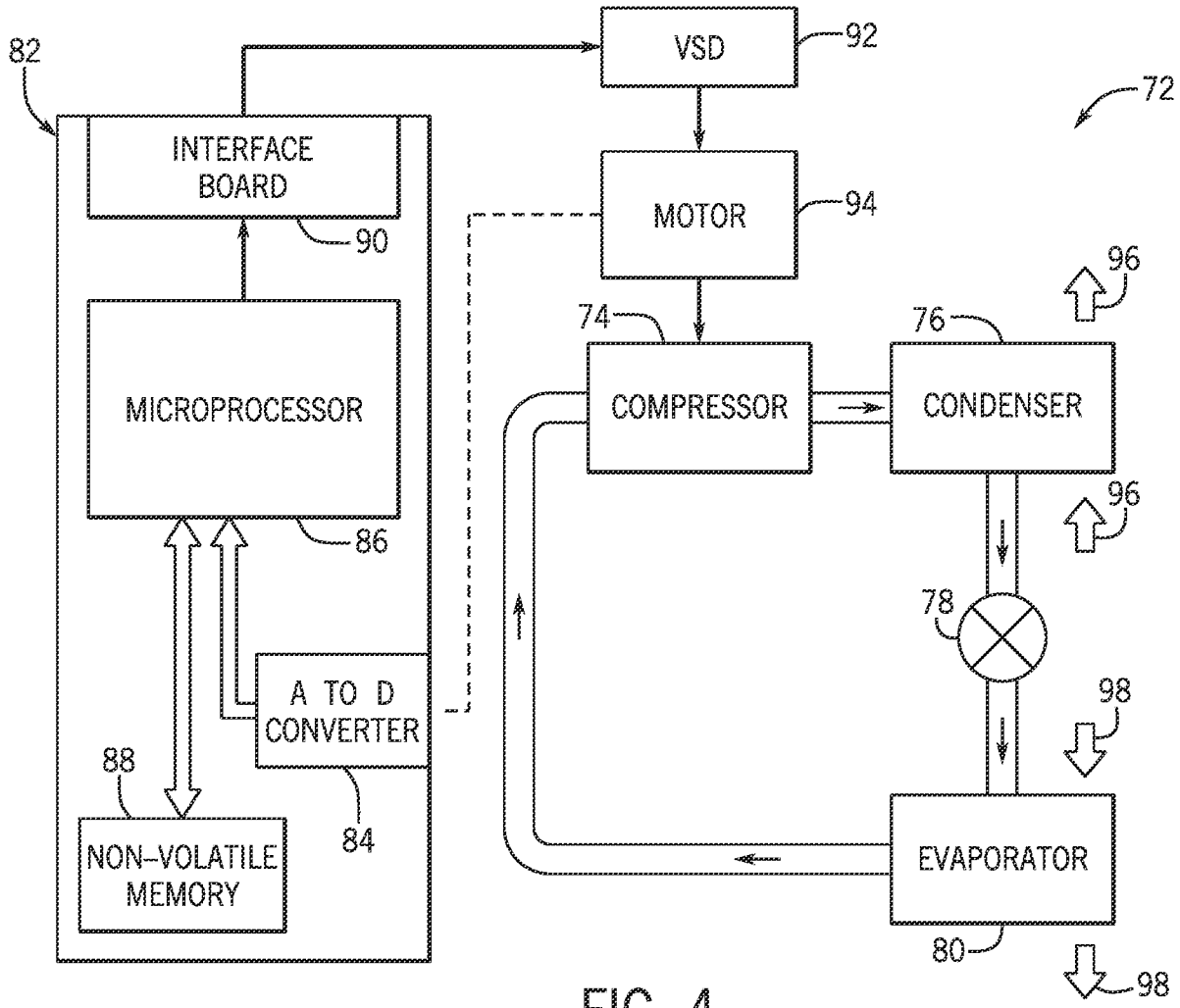
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC systems typically include a drain pan configured to collect condensate that may form during operation of the HVAC system. Unfortunately, conventional systems generally rely on the force of gravity to direct condensate from a heat exchanger to the drain pan, which may not adequately facilitate desirable collection of condensate. For example, HVAC systems oriented to direct air flow across a heat exchanger in a lateral direction (e.g., horizontal right configuration, horizontal left configuration) may be susceptible to peripheral or external discharge of condensate. In other words, conventional drain pans may not adequately capture condensate generated during operation of the HVAC system, and condensate may undesirably travel (e.g., via air flow directed across the heat exchanger) to regions or areas external to the drain pan. Accordingly, embodiments of the present disclosure are directed toward a condensate collection assembly that is configured to more efficiently capture condensate generated during HVAC system operation.

Figure 5:
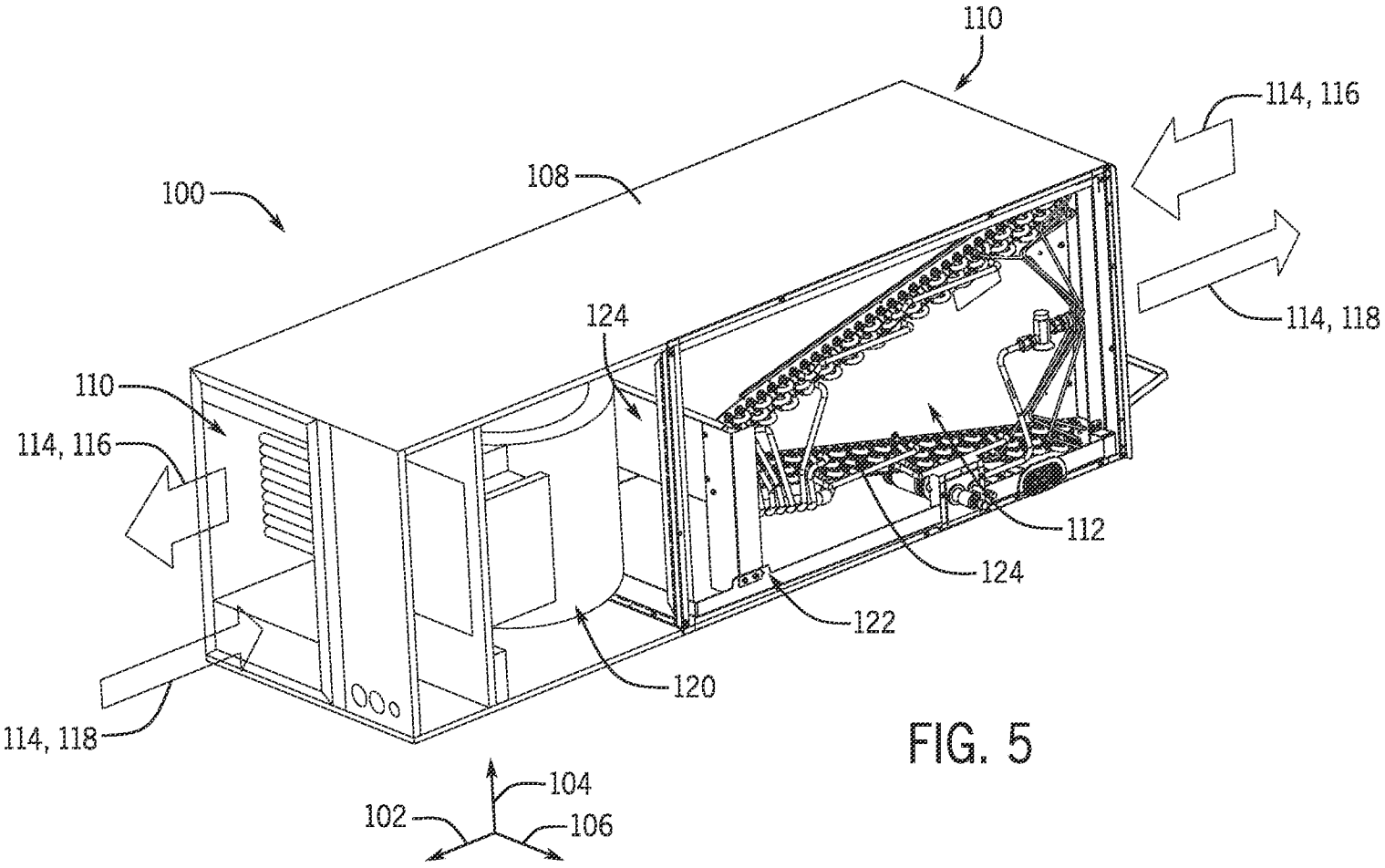
FIG. 5 is a perspective view of an embodiment of an HVAC unit including a condensate collection assembly, in accordance with an aspect of the present disclosure.

With the foregoing in mind, FIG. 5 is a perspective view of an embodiment of an HVAC unit 100 that can be used in any suitable HVAC system, such as the HVAC unit 12 of FIG. 1, the split, residential HVAC system 50 of FIG. 3, and/or the vapor compression system 72 of FIG. 4. Indeed, it should be noted that the HVAC unit 100 may include embodiments and/or components of the HVAC unit 12, embodiments or components of the split, residential HVAC system 50, a rooftop unit (RTU), an air handler or air handling unit, an outdoor unit, and indoor unit, or any other suitable HVAC system. To facilitate discussion, the HVAC unit 100 and its respective components may be described with reference to a longitudinal axis 102, a vertical axis 104, which is oriented relative to a direction of gravity, and a lateral axis 106.

In the illustrated embodiment, the HVAC unit 100 includes a housing 108 defining an air flow path 110 therethrough. A heat exchanger 112 is disposed within the housing 108 and along the air flow path 110. The HVAC unit 100 is configured to direct an air flow 114 through the housing 108 and across the heat exchanger 112 to enable conditioning of the air flow 114. For example, the heat exchanger 112 may be an evaporator or other cooling coil configured to cool the air flow 114 directed through the housing 108. In the illustrated embodiment, the housing 108 and the heat exchanger 112 are arranged in a generally horizontal flow configuration. In other words, the housing 108 is configured to direct the air flow 114 in a generally horizontal direction (e.g., along the longitudinal axis 102) along the air flow path 110 and across the heat exchanger 112. In some embodiments, the air flow 114 may be directed in through the housing 108 and across the heat exchanger 112 in a first direction 116 (e.g., in a horizontal left configuration of the heat exchanger 112) or in a second direction 118 (e.g., in a horizontal right configuration of the heat exchanger 112). In the illustrated embodiment, the HVAC unit 100 includes a blower 120 configured to draw the air flow 114 into the housing 108 and across the heat exchanger 112 and to discharge the air flow 114 from the housing 108. The air flow 114 may enter the housing 108 as a preconditioned air flow, a return air flow, an ambient air flow, any combination thereof, or another suitable air flow. The air flow 114 discharged from the HVAC unit 100 may be directed toward a conditioned space, such as via ductwork fluidly coupled to the air flow path 110.

As mentioned above, the heat exchanger 112 is configured to condition the air flow 114 directed through the housing 108 and across the heat exchanger 112. For example, the heat exchanger 112 may be an evaporator configured to cool the air flow 114. In some instances, the housing 108 may also include an additional heat exchanger disposed within the air flow path 110, such as a heating coil. In certain operating modes of the HVAC unit 100, the heat exchanger 112 (e.g., evaporator, cooling coil) and additional heat exchanger (e.g., heating coil) may operate in conjunction with one another to dehumidify the air flow 114. During cooling and/or dehumidification of the air flow 114, moisture within the air flow 114 may condense to form condensate in the form of liquid droplets. For example, condensate may form and/or collect on the heat exchanger 112.

As will be appreciated, it is desirable to collect and discharge condensate generated during operation of the HVAC unit 100 in a suitable manner. For example, it is desirable to capture the condensate and drain the condensate along a suitable flow path, as well as mitigate transfer of condensate to unintended areas or region (e.g., within the housing 108, external to the housing 108). Accordingly, the HVAC unit 100 includes a condensate collection assembly 122 configured to capture and collect condensate generated from the air flow 114 during operation of the HVAC unit 100. For example, the condensate collection assembly 122 is configured to capture and collect condensate that may form on the heat exchanger 112 and may fall from the heat exchanger 112 (e.g., along vertical axis 104) due to force of gravity. The condensate collection assembly 122 is also configured to capture condensate that may be dislodged from the heat exchanger 112 (e.g., at least partially along longitudinal axis 102) via the air flow 114 directed across the heat exchanger 112. As described herein, condensate dislodged from the heat exchanger 112 by the air flow 114 and traveling at least partially in a direction of the air flow 114 may be referred to as "condensate blowoff" or "condensate carryover." The condensate collection assembly 122 of the present disclosure is configured to capture condensate blowoff or carryover and block condensate exposure to unintended areas, such as certain areas within the housing 108, the blower 120, filters (e.g., filter 38) within the housing 108, ductwork (e.g., ductwork 14 and 68) fluidly coupled to the housing 108, and/or other unintended areas associated with the HVAC unit 100 (e.g., building 10, residence 52).

In the illustrated embodiment, the condensate collection assembly 122 includes components disposed beneath (e.g., relative to vertical axis 104) the heat exchanger 112. The condensate collection assembly 122 also includes components disposed on or adjacent lateral sides 124 (e.g., vertically-extending sides) of the heat exchanger 112. In other words, the condensate collection assembly 122 includes components disposed laterally outward (e.g., relative to longitudinal axis 102 and/or lateral axis 106) from the heat exchanger 112. In the manner described below, the components of the condensate collection assembly 122 enable capture and collection of condensate that may fall from the heat exchanger 112 (e.g., along vertical axis 104), as well as condensate that may be dislodged by the air flow 114 directed across the heat exchanger 112. The condensate captured and collected by the condensate collection assembly 122 may then be discharged or drained from the HVAC unit 100 in a desirable manner.

The embodiments discussed below with reference to FIGS. 6-9 are described in the context of the HVAC unit 100 arranged to direct the air flow 114 through the housing 108 of the HVAC unit 100 in the first direction 116. In other words, the HVAC unit 100 and condensate collection assembly 122 described as implemented with the HVAC unit 100 in a horizontal left configuration. However, it should be appreciated that embodiments of the condensate collection assembly 122 may be similarly implemented with the HVAC unit 100 oriented in a horizontal right configuration and with the air flow 114 directed through the housing 108 in the second direction 118 discussed above.

Figure 6:
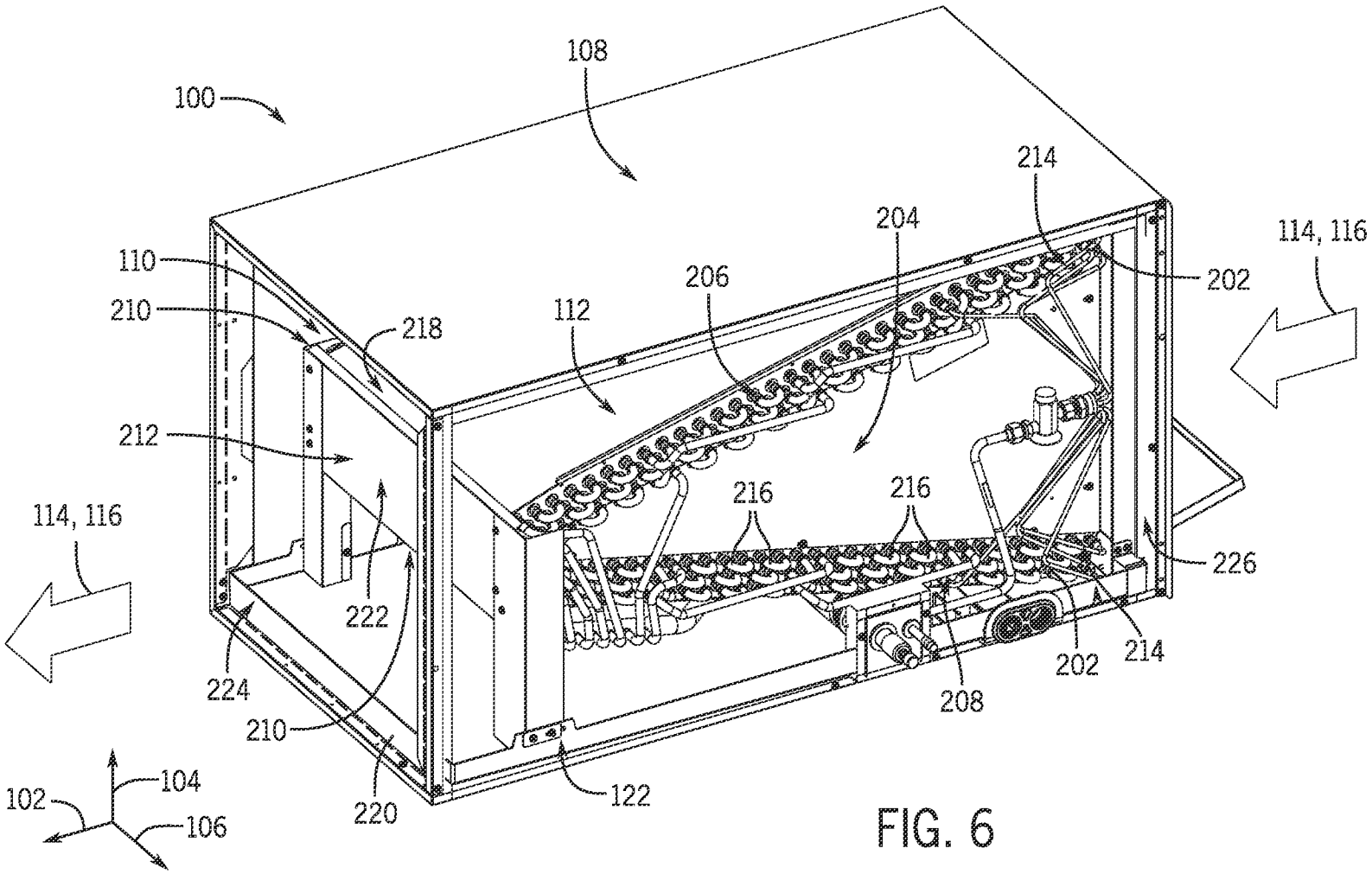
FIG. 6 is a partial perspective view of an embodiment of an HVAC unit including a condensate collection assembly, in accordance with an aspect of the present disclosure.

FIG. 6 is a perspective view of an embodiment of a portion of the HVAC unit 100. For clarity and to better illustrate the condensate collection assembly 122, the blower 120 and certain portions of the housing 108 are not shown. In some embodiments, the heat exchanger 112 disposed within the HVAC unit 100 may include one or more heat exchange coils 202 (e.g., slabs) disposed along the air flow path 110. For example, the heat exchanges coils 202 may be tube and fin heat exchange coils. The heat exchanger 112 also includes one or more delta plates 204 coupled to the heat exchange coils 202. The one or more delta plates 204 may function to support the one or more heat exchange coils 202 in a desired configuration (e.g., relative to one another). In the illustrated embodiment, the heat exchanger 112 includes two heat exchange coils 202 arranged in an "A" coil configuration. However, in other embodiments, heat exchange coils 202 may be arranged in a "V", "N", or "Z" coil configuration. In some embodiments, the heat exchanger 112 may include one heat exchange coil 202 disposed along the air flow path 110. The heat exchange coils 202 may be oriented in any suitable configuration along the air flow path 110 relative to the lateral axis 106, longitudinal axis 102, and/or vertical axis 104.

In the illustrated A-coil configuration, the heat exchange coils 202 (e.g., a first heat exchange coil 206, a second heat exchange coil 208) are disposed at an angle relative to one another and relative to the first direction 116 of the air flow 114 through the housing 108. The first heat exchange coil 206 extends along the longitudinal axis 102 at a downward slope or angle relative to the vertical axis 104, and the second heat exchange coil 208 extends along the longitudinal axis 102 at an upward slope or angle relative to the vertical axis 104. Thus, the heat exchange coils 202 converge towards one another in the first direction 116 along the longitudinal axis 102, such that respective downstream ends 210 (e.g., relative to the first direction 116 of air flow 114) of the first heat exchange coil 206 and the second heat exchange coil 208 define an apex 212 (e.g., a vertex of the A-coil configuration) of the heat exchanger 112. During operation of the HVAC unit 100, the air flow 114 may initially flow along the air flow path 110 between (e.g., relative to vertical axis 104) respective upstream ends 214 (e.g., relative to the first direction 116 of air flow 114) of the first heat exchange coil 206 and the second heat exchange coil 208. As the air flow 114 travels along the air flow path 110, the air flow 114 may pass across the heat exchange coils 202. Thereafter, the air flow 114 may continue traveling along the air flow path 110 through the housing 108 (e.g., toward the blower 120).

As mentioned above, each heat exchange coil 202 may include rows of tubes 216 configured to direct refrigerant or working fluid therethrough. Each heat exchange coil 202 may also include fins 218 coupled to and extending between the respective tubes 216. The fins 218 may support the arrangement of tubes 216 and may also be configured to increase a heat transfer surface area of the heat exchange coils 202. During operation of the HVAC unit 100 to cool the air flow 114 via the heat exchanger 112, heat may be transferred from the refrigerant circulated through the tubes 216 of the heat exchange coils 202. As a result, moisture within the air flow 114 may condense to form condensate (e.g., water droplets) that may collect on heat exchange coils 202 (e.g., tubes 216, fins 218, and/or the delta plates 204). In some instances, the velocity and/or turbulence of the air flow 114 may cause condensate formed on one or more of the heat exchange coils 202 to travel at least partially in the first direction 116. That is, the air flow 114 may drive or force condensate formed on the heat exchange coils 202 to migrate in the first direction 116 (e.g., along the fins 218, toward the apex 212 of the heat exchanger 112).

To capture and collect condensate generated via operation of the heat exchanger 112, the HVAC unit 100 includes the condensate collection assembly 122. As shown, the condensate collection assembly 122 may be configured to couple with one or more of the heat exchange coils 202, one or more of the delta plates 204, or both. In some embodiments, the condensate collection assembly 122 may be secured to the heat exchanger 112 to provide structural support (e.g., at least partially support a weight) for the heat exchanger 112 within the HVAC unit 100. In the illustrated embodiment, the condensate collection assembly 122 includes a drain pan 220 disposed within the housing 108 and beneath the heat exchanger 112 relative to the vertical axis 104. The condensate collection assembly 122 also includes a condensate capture assembly 222 disposed within the housing 108 and adjacent one or more lateral sides 124 of the heat exchanger 112. That is, the condensate capture assembly 222 is disposed at least partially laterally outward from the heat exchanger 112 (e.g., along longitudinal axis 102 and/or lateral axis 106). The condensate capture assembly 222 is at least partially disposed within (e.g., across) the air flow path 110 defined by the housing 108. The condensate capture assembly 222 is coupled to the drain pan 220 and is disposed within an outer perimeter 224 of the drain 220. In this way, the condensate capture assembly 222 may be configured to direct captured condensate into the drain pan 220. The condensate capture assembly 222 further includes a support frame 226 coupled to the drain pan 220 and disposed within the outer perimeter 224 of the drain pan 220. Similar to the condensate capture assembly 222, the support frame 226 may also be coupled to the heat exchanger 112 and may provide structural support for the heat exchanger 112 within the housing 108. Details of the condensate collection assembly 122 are described further below.

Figure 7:
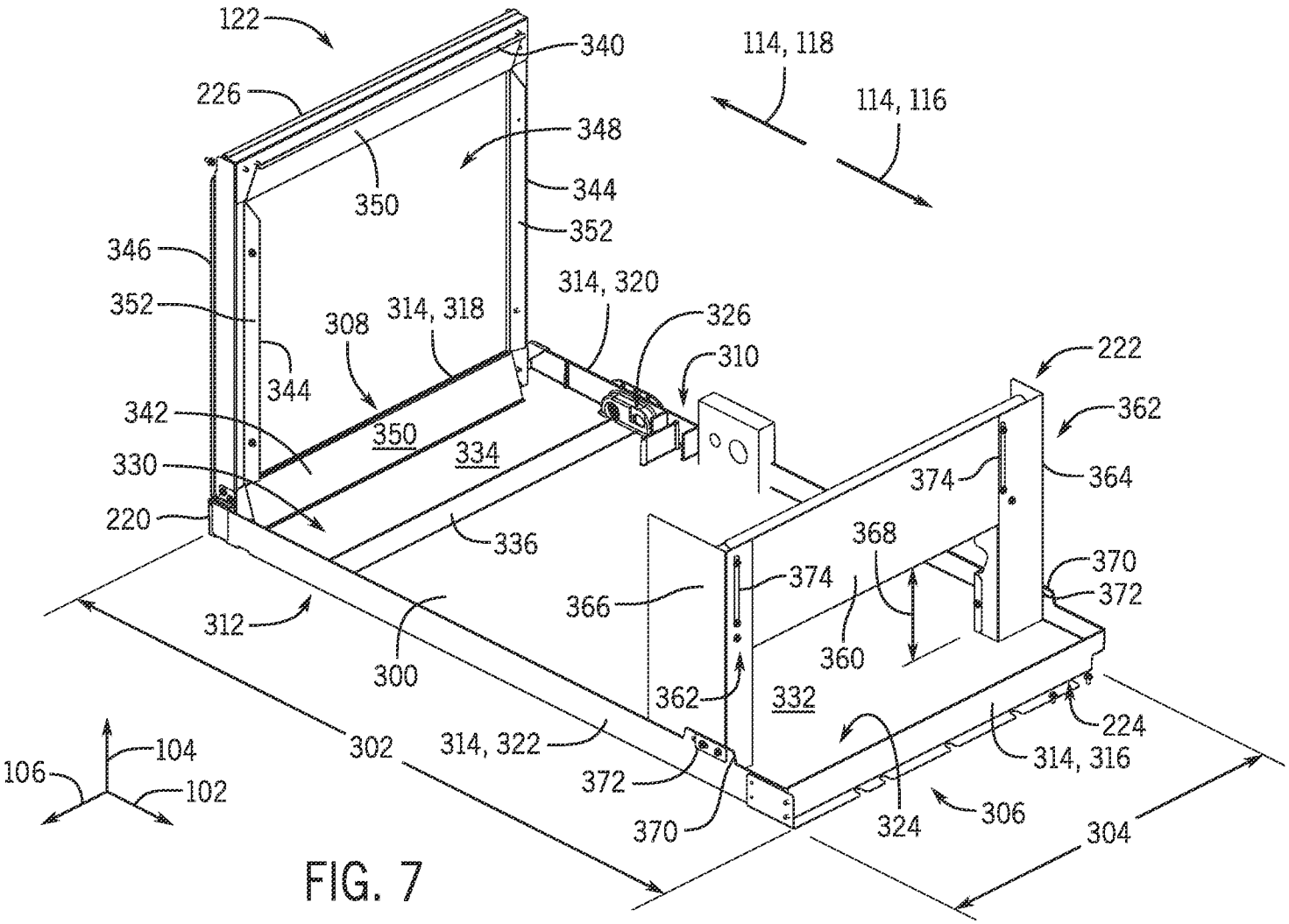
FIG. 7 is a perspective view of an embodiment of a condensate collection assembly, in accordance with an aspect of the present disclosure.

FIG. 7 is a perspective view of an embodiment of the condensate collection assembly 122, which may be disposed within the HVAC unit 100 or any other suitable HVAC system having a heat exchanger 112 that may generate condensate. As mentioned above, the condensate collection assembly 122 may include the drain pan 220, the condensate capture assembly 222, and the support frame 226. In the illustrated embodiment, the drain pan 220 includes a body portion 300 (e.g., a base, base surface, condensate collection surface) defining and extending along a length 302 of the drain pan 220 from a first end portion 306 (e.g., longitudinal end, longitudinal side) to a second end portion 308 (e.g., longitudinal end, longitudinal side) of the drain pan 220. For clarity, it should be noted that the length 302 may extend generally along to the longitudinal axis 102. The body portion 300 also defines and extends along a width 304 of the drain pan 220 from a third end portion 310 (e.g., lateral end, lateral side) to a fourth end portion 312 (e.g., lateral end, lateral side), and the width 304 may extend generally along to the lateral axis 106.

The drain pan 220 also includes a plurality of walls 314 (e.g., side walls) extending from the body portion 300. In particular, the drain pan 220 includes a first wall 316 extending from the body portion 300 at the first end portion 306, a second wall 318 extending from the body portion 300 at the second end portion 308, a third wall 320 extending from the body portion 300 at the third end portion 310, and a fourth wall 322 extending from the body portion 300 at the fourth end portion 312. The first, second, third, and fourth walls 316, 318, 320, and 322 may generally define the outer perimeter 224 of the drain pan 220. The body portion 300 and the plurality of walls 314 cooperatively define a basin 324 (e.g., reservoir, cavity, container, receptacle) of the drain pan 220 that is configured to capture and collect condensate generated during operation of the heat exchanger 112. For example, condensate may fall from the heat exchanger 112 (e.g., along vertical axis 104, via gravity) into the basin 324. Additionally, in the manner described in further detail below, the condensate capture assembly 222 may capture condensate (e.g., dislodged from the heat exchanger 112 via the air flow 114) and direct the condensate into the basin 324.

The body portion 300 of the drain pan 220 defines or includes a draining surface 330. The first, second, third, and fourth walls 316, 318, 320, and 322 extend from the draining surface 330 and are configured to retain condensate directed into the basin 324. The drain pan 220 further includes a drain port 326 configured to enable discharge of condensate collected within the basin 324. For example, the drain port 326 may be fluidly coupled to a discharge conduit configured to direct condensate toward a location external to the HVAC unit 100. In the illustrated embodiment, the drain port 326 is formed in and/or coupled to the third wall 320 of the drain pan 220, but in other embodiments the drain port 326 may be disposed in another suitable location of the drain pan 220.

In some embodiments, the draining surface 330 of drain pan 220 may include a slope (e.g., a compound slope) that enables drainage of condensate collected with the basin 324. In other words, one or more portions of the draining surface 330 may be disposed at an angle relative to horizontal (e.g., sloped downwardly relative to gravity) to promote flow of condensate along the draining surface 330 generally towards the drain port 326. In this way, condensate collected within the drain pan 220 may be suitably discharged from the HVAC unit 100. For example, the draining surface 330 may be sloped downwardly (e.g., with respect to gravity, relative to vertical axis 104) toward the drain port 326, such that force of gravity may direct condensate accumulated on the draining surface 330 toward the drain port 326. In some embodiments, one or more portions of the draining surface 330 may include a compound slope angled downwardly along the length 302 of the drain pan 220. For example, in the illustrated embodiment, the draining surface 330 (e.g., body portion 300) includes a first portion 332 and a second portion 334 that each may be sloped (e.g., downwardly sloped relative to gravity and/or vertical axis 104) toward a draining channel 336 of the draining surface 330 that is positioned between (e.g., relative to longitudinal axis 102 and/or the length 302) the first portion 332 and the second portion 334. That is, the first portion 332 may be downwardly sloped (e.g., along longitudinal axis 102) from the first wall 316 to the draining channel 336, and the second portion 334 may be downwardly sloped (e.g., along longitudinal axis 102) from the second wall 318 to the draining channel 336. In some embodiments, the draining surface 330 may be sloped (e.g., downwardly sloped relative to gravity and/or vertical axis 104) along the width 304 of the drain pan 220, such as from the fourth wall 322 to the third wall 320 (e.g., along lateral axis 106). Indeed, one or more of the first portion 332, the second portion 334, and the draining channel 336 may be sloped downwardly toward the third wall 320 and/or the drain port 326. Accordingly, the compound slope of the draining surface 330 (e.g., the first portion 332, the second portion 334) may enable condensate collected on the draining surface 330 to flow generally along a direction of decline of the draining surface 330 toward the drain port 326. In such embodiments, the drain port 326 may be located at a lower-most portion (e.g., relative to gravity and/or vertical axis 104) of the draining surface 330. In this manner, the drain pan 220 may be configured to promote drainage and/or discharge of condensate from the basin 324 via the drain port 326.

As illustrated in FIG. 7, the condensate collection assembly 122 also includes the support frame 226, which may be positioned at or adjacent one or more lateral end 124 of the heat exchanger 112 in an assembled and installed configuration of the condensate collection assembly 122 with the heat exchanger 112. In some embodiments, the support frame 226 may be coupled to the drain pan 220 and may extend generally vertically (e.g., along vertical axis 104) from the drain pan 220. In the illustrated embodiment, the support frame 226 is a generally quadrangular structure and includes a head 340 (e.g., top portion, upper rail) extending along the lateral axis 106, a sill 342 (e.g., bottom portion, lower rail) extending along the lateral axis 106, and a pair of sides 344 (e.g., side extensions, side rails) extending from the head 340 to the sill 342 along the vertical axis 104. Specifically, the head 340, the sill 342, and the pair of sides 344 form an outer periphery 346 (e.g., outer perimeter 224) of the support frame 226. The head 340, the sill 342, and the pair of sides 344 also define an opening or passage 348 extending through the support frame 226. The passage 348 is configured to enable flow of the air flow 114 along the air flow path 110 through the housing 108 and across the heat exchanger 112. In some embodiments, the head 340, the sill 342, or both may include a respective angled extension 350 that is configured to abut and/or support one of the heat exchange coils 202. For example, the angled extension 350 of the head 340 may abut and/or support the upstream end 214 of first heat exchange coil 206, and the angled extension 350 of the sill 342 may abut and/or support the upstream end 214 of the second heat exchange coil 208. In certain embodiments, one or both of the angled extensions 350 may additionally or alternatively be configured to guide the air flow 114 along the air flow path 110 (e.g., in the second direction 118, in a horizontal right configuration of the HVAC unit 100) and/or may be configured to guide or block flow of condensate laterally outward from the heat exchanger 112 (e.g., along longitudinal axis 102).

Further, in some embodiments, the head 340 and/or the sill 342 may be configured to couple to one or more of the heat exchange coils 202. For example, in one embodiment, the head 340 may include a profile, geometry, and/or feature corresponding to a profile, geometry, and/or feature of the upstream end 214 of the first heat exchange coil 206. Similarly, the sill 342 may include a profile, geometry, and/or feature corresponding to a profile, geometry, and/or feature of the upstream end 214 of the second heat exchange coil 208. In this way, the head 340 and/or the sill 342 may be adapted and designed to be secured to (e.g., support, abut) the upstream ends 214 of the first heat exchange coil 206 and the second heat exchange coil 208, respectively. Further, in some embodiments, the pair of sides 344 of the support frame 226 may include a flange 352 (e.g., extension, mounting flange) configured to enable securement (e.g., via fasteners) of the support frame 226 to the delta plates 204 positioned on either side of the heat exchanger 112.

In some embodiments, the support frame 226 may be configured to capture condensate generated by the heat exchanger 112 and to direct the condensate towards the drain pan 220 positioned beneath the heat exchanger 112. As shown in the illustrated embodiment, at least a portion of each of the head 340, the sill 342, and the pair of sides 344 may be positioned within the drain pan 220 (e.g., within the outer perimeter 224 of the drain pan 220). Thus, for example, condensate that may form and/or accumulate on the support frame 226 may travel (e.g., via force of gravity, along vertical axis 104) and be guided into the basin 324 of drain pan 220 by the support frame 226.

As mentioned above, the condensate collection assembly 122 also includes the condensate capture assembly 222. In some embodiments, the condensate capture assembly 222 may be positioned disposed on or adjacent one or more lateral sides 124 of the heat exchanger 112. For example, the condensate capture assembly 222 may be positioned at an end of the heat exchanger 112 opposite the support frame 226. Referring back to FIG. 6, the condensate capture assembly 222 is illustrated as disposed at a downstream end of the heat exchanger 112 relative to air flow 114 in the first direction 116 (e.g., a horizontal left configuration of the HVAC unit 100), while the support frame 226 is disposed at an upstream end 214 of the heat exchanger 112. However, it should be noted that the installed configuration of the condensate collection assembly 122 shown in FIG. 6 may be similarly utilized with embodiments of the HVAC unit 100 oriented in a horizontal right configuration (e.g., to direct the air flow 114 in the second direction 118).

Further, in some embodiments, the condensate capture assembly 222 may be configured to provide structural support for the heat exchanger 112 (e.g., at least partially support a weight of the heat exchanger 112). To this end, the condensate capture assembly 222 may be configured to couple to one or more components of the heat exchange coils 202. The condensate capture assembly 222 is also configured to capture condensate that may be generated via operation of the heat exchanger 112. In particular, the condensate capture assembly 222 may be configured to capture condensate that forms on the heat exchange coils 202 and is subsequently dislodged from the heat exchange coils 202 via the air flow 114 (e.g., traveling in the first direction 116). Condensate captured by the condensate capture assembly 222 may then be directed (e.g., via features of the condensate capture assembly 222 and/or via gravity) into the basin 324 of the drain pan 220 positioned beneath the heat exchanger 112. Details of the condensate capture assembly 222 are described further below.

Continuing with reference to FIG. 7, the condensate capture assembly 222 includes a shield panel 360 (e.g., condensate barrier, capture panel, blocking plate) and support members 362 (e.g., posts, supports, extensions, structural members). While the illustrated embodiment includes a first support member 364 and a second support member 366, other embodiments of the condensate capture assembly 222 may include one, three, four, or more than four support members 362. The support members 362 are configured to couple to the drain pan 220, and the shield panel 360 is configured to couple to the support members 362. In particular, the shield panel 360 is coupled to the support members 362 and positioned at an offset distance 368 (e.g., a spaced arrangement) from the drain pan 220 along the vertical axis 104. Thus, in an installed configuration of the condensate collection assembly 122 with the heat exchanger 112 in the HVAC unit 100, as shown in FIG. 6, the shield panel 360 is disposed within the air flow path 110 extending through the housing 108 of the HVAC unit 100. The shield panel 360 may extend across the air flow path 110 and/or across the heat exchange coils 202 along the lateral axis 106. More specifically, the shield panel 360 is positioned within the air flow path 110 downstream of the heat exchange coils 202 (e.g., relative to the first direction 116 of the air flow 114), such that the shield panel 360 overlaps with the apex 212 of the heat exchanger 112 with respect to the longitudinal axis 102. As also shown in FIG. 6, the support members 362 are positioned adjacent one or more lateral sides 124 of the heat exchanger 112 in the installed configuration. The support members 362 may be spaced from the heat exchange coils 202 (e.g., relative to the longitudinal axis 102 and/or lateral axis 106), in some embodiments.

Referring back to FIG. 7, in an assembled configuration, the first and second support members 364 and 366 are disposed within the basin 324 (e.g., within the outer perimeter 224 of the drain pan 220 defined by the plurality of walls 314. As mentioned above, the first and second support members 364 and 366 are configured to couple to the drain pan 220. Specifically, in the illustrated embodiment, the first support member 364 is coupled to the third wall 320 of the drain pan 220, and the second support member 366 is coupled to the fourth wall 322 of the drain pan 220. To facilitate securement of the support members 362 to the drain pan 220, the third wall and fourth wall 364 and 366 each include a respective protruding member 370 (e.g., flange, extension, tab) having at least one slot 372 (e.g., opening, aperture) formed therein. The support members 362 may be secured to the drain pan 220 via one or more fasteners extending through the slots 372 and the support members 362. Further, the slots 372 are shown as extending along the respective protruding members 370 along the longitudinal axis 102. Accordingly, the slots 372 may enable positional adjustment (e.g., along the longitudinal axis 102) of the support members 362, and thus the shield panel 360, relative to the drain pan 220 and relative to the heat exchanger 112. The shield panel 360 may be similarly coupled to the support members 362 via mechanical fasteners. For example, the support members 362, the shield panel 360, or both may include one or more openings 374 (e.g., slots, apertures) configured to receive mechanical fasteners therethrough to secure the shield panel 360 to the support members 362. Similar to the slots 372 of the protruding members 370, the openings 374 of the support members 362 and/or shield panel 360 may enable positional adjustment (e.g., along the vertical axis 104) of the shield panel 360 relative to the support members 362, relative to the heat exchanger 112, and/or relative to the drain pan 220. While the illustrated embodiment of the condensate capture assembly 222 shows the shield panel 360 and the support members 362 as separate components coupled to one another, other embodiments of the condensate capture assembly 222 may be formed as a single piece. In any case, the components of the condensate capture assembly 222 may be formed from any suitable material, such as sheet metal, and may be formed via any suitable process, such as cutting, bending, welding, and so forth.

In some embodiments, the first and second support members 364 and 366 may also be coupled to the heat exchange coils 202 of the heat exchanger 112. Securement of the support members 362 to the heat exchange coils 202 may provide structural support to the heat exchanger 112 and/or may enable retention of the heat exchanger 112 and/or condensate capture assembly 222 in a desired position within the housing 108. Additionally or alternatively, the shield panel 360 may be configured to couple to the heat exchange coils 202 to provide structural support to the heat exchanger 112 and/or to retain the heat exchanger 112 and/or condensate capture assembly 222 in a desired position within the housing 108. Furthermore, the first and second support members 364 and 366 may be configured to direct condensate captured by the shield panel 360 towards the drain pan 220. Features and operation of the condensate capture assembly 222 is described in further detail below with reference to FIGS. 8 and 9.

FIG. 8 is perspective view of an embodiment of the condensate capture assembly 222 that may be included in the HVAC unit 100. As discussed above, the condensate capture assembly 222 is configured to capture condensate that may form on the heat exchanger 112 and become dislodged from the heat exchanger 112 via the air flow 114 (e.g., condensate blowoff). In other words, the condensate capture assembly 222 is configured to capture condensate that may be carried or driven by the air flow 114 (e.g., in the first direction 116, along the longitudinal axis 102) that may not fall into the drain pan 220 via gravity. Thus, the condensate capture assembly 222 is configured to block discharge of condensate beyond and/or away from the drain pan 220, thereby reducing exposure of other components (e.g., the housing 108, ductwork, the blower 120, etc.) to the condensate. The condensate capture assembly 222 is also configured to direct the captured condensate to the drain pan 220 disposed beneath the exchanger 112. In this way, the condensate capture assembly 222 facilitates desirable drainage of condensate from the HVAC unit 100 (e.g., via the drain port 326). As similarly described above, the illustrated embodiment of the condensate capture assembly 222 includes the shield panel 360 coupled to the support members 362 (e.g., the first and second support members 364 and 366). The illustrated embodiment also includes brackets 402 (e.g., mounting brackets) coupled to the shield panel 360 and cover plates 404 coupled to the support members 362, which are described further below.

As discussed above, in some embodiments, the shield panel 360 may be positioned within the air flow path 110 and may be suspended above the drain pan 220 (e.g., relative to vertical axis 104) in an overlapping arrangement with the heat exchanger 112 (e.g., along longitudinal axis 102) in an installed configuration of the condensate collection assembly 220. Accordingly, the shield panel 360 may include a main body 406 (e.g., panel, plate) having a width 408 extending along the lateral axis 106 and a height 410 extending along the vertical axis 104. The width 408 and height 410 of the main body 406 may extend within the air flow path 110 and may overlap with at least a portion of the apex 212 (e.g., downstream ends 210 of the heat exchange coils 202) in an installed configuration. As will be appreciated, the main body 406 may also have a depth (e.g., extending along longitudinal axis 102), which may correspond to a thickness of material utilized to form the shield panel 360. The main body 406 defines a condensate capture surface 412 (e.g. impingement surface, deflecting surface, blocking surface) configured to enable capture of condensate discharged from the heat exchanger 112 (e.g., in the first direction 116) via the air flow 114 directed across the heat exchanger 112. The condensate capture surface 412 may therefore face the heat exchanger 112 (e.g., face the second direction 118) in an installed configuration of the condensate capture assembly 222.

In some embodiments, the condensate capture surface 412 may be oriented substantially along the vertical axis 104. As such, condensate dislodged from the heat exchanger 112 (e.g., from downstream ends 210 of the heat exchange coils 202) in the first direction 116 by the air flow 114 may contact and/or impinge against the condensate capture surface 412 and may then be directed downward (e.g., along vertical axis 104, along the condensate capture surface 412) by gravity.

That is, condensate that impinges against the condensate capture surface 412 may travel toward a bottom edge 414 (e.g., base, lower portion, first edge) of the shield panel 360. In some embodiments, the condensate capture surface 412 may be a substantially smooth surface. In other embodiments, the condensate capture surface 412 may include a surface treatment, surface formations (e.g., bumps, grooves), or other features configured to direct or guide the captured condensate along the condensate capture surface 412 towards the bottom edge 414 in a desired manner.

In the illustrated embodiment, the shield panel 360 includes a channel 416 extending along the bottom edge 414 of the shield panel 360. The channel 416 may be integrally formed with the main body 406 (e.g., via a bending process) or may be formed via one or more separate components coupled to the main body 406. In some embodiments, the channel 416 may be configured in a "U" shape to enable capture of condensate therein. For example, the channel 416 may be formed or defined by the main body 406, a lower extension 418 (e.g., base, bottom portion) extending from the main body 406 (e.g., in the second direction 118, toward the heat exchanger 112), and an distal extension 420 extending from the lower extension 418 (e.g., along the vertical axis 104, away from the drain pan 220). However, it should be understood that the configuration of the channel 416 may have any suitable shape, such as a "V" shape or semi-circular shape, configured to capture condensate therein. Condensate that impinges against the condensate capture surface 412 may flow into the channel 416, from which the condensate may be further directed toward the drain pan 220 positioned beneath the heat exchanger 112 and the condensate capture assembly 222.

In the illustrated embodiment, the shield panel 360 further includes a flange 422 (e.g., extension) extending from and along a top edge 424 (e.g., top portion, second edge) of the main body 406 opposite the bottom edge 414. For example, the flange 422 may extend along the width 408 of the shield panel 360. The flange 422 may be positioned at an angle relative to the main body 406 and/or the condensate capture surface 412. In particular, the flange 422 may extend at least partially along the longitudinal axis 102 in the second direction 118 and may therefore extend at least partially toward the heat exchanger 112. As a result, the flange 422 may be configured to block condensate dislodged from the heat exchanger 112 (e.g., via the air flow 114 in the first direction 116) from passing over or across the condensate capture assembly 222. The flange 422 may be integrally formed with the main body 406 (e.g., via a bending process) or may be a separate component coupled to the main body 406.

As mentioned above, the condensate capture assembly 222 may include one or more brackets 402. The brackets 402 are configured to enable securement of the condensate capture assembly 222 to the heat exchanger 112. In the illustrated embodiment, each bracket 402 has an L-shaped configuration or geometry and is coupled to the main body 406 of the shield panel 360 (e.g., in abutment with the condensate capture surface 412). As will be appreciated, the brackets 402 may be secured to the shield panel 360 via mechanical fasteners, an adhesive, welding, brazing, or other suitable technique. In some embodiments, the brackets 402 may be coupled to (e.g., secured to) the support members 362 instead of or in addition to the shield panel 360. In an installed configuration with the HVAC unit 100, each bracket 402 may also be mechanically secured to one or more of the heat exchange coils 202. For example, each bracket 402 may be secured or attached to one or more downstream ends 210 of the heat exchange coils 202, end sheets of the heat exchanges coils 202, or any other suitable portion of the heat exchange coils 202. In this way, the condensate capture assembly 222 may provide structural support and or rigidity for the heat exchanger 112 within the drain pan 220 and the housing 108.

Condensate captured within the channel 416 of the shield panel 360 may be directed toward the drain pan 220 via one or more of the support members 362 (e.g., via the first support member 364 and/or the second support member 366). The support members 362 may be configured in any suitable shape or geometry, such as an L-shaped or U-shaped geometry. The configuration of the support members 362 may be selected to enable coupling between the support members 362 and the shield panel 360. In addition, a configuration of the support members 362 may be selected to enable coupling between the support members 362 and the drain pan 220. In some embodiments, the support members 362 may abut or contact the draining surface 330 of the drain pan 220 in an assembled configuration of the support members 362 with the drain pan 220. In other embodiments, one or more portions of the support members 362 may be spaced apart from the draining surface 330 in the assembled configuration.

In the illustrated embodiment, the first support member 364 and the second support member 366 each have a substantially U-shaped geometry or configuration that is configured to extend from the basin 324 of the drain pan 220 in the assembled configuration of the condensate collection assembly 122 (e.g., extending along the vertical axis 104). Specifically, the first and second support members 364 and 366 each include an outer wall 426, a median wall 428 (e.g., intermediate wall), and an inner wall 430. The outer, median, and inner walls 426, 428, and 430 of the various support members 362 may have the same, similar, or different dimensions relative to one another. Further, the outer, median, and inner walls 426, 428, and 430 of each support member 362 cooperatively define a respective passage 432 of the corresponding support member 362. As shown, the shield panel 360 is coupled to each support member 362, such that the channel 416 extends above the passages 432 (e.g., relative to vertical axis 104) and is generally aligned with (e.g., overlaps with) the passages 432 along the vertical axis 104. As distal ends 434 of the channel 416 (e.g., above and aligned with the passages 432) are generally open and/or unobstructed, condensate captured by the channel 416 of the shield panel 360 may flow into the passages 432, as indicated by arrows 436. The condensate may flow downwardly within passages 432 along the vertical axis 104 and into the basin 324 of the drain pan 220 beneath the condensate capture assembly 222 and the heat exchanger 112.

The condensate capture assembly 222 may also include one or more cover plates 404 configured to block the air flow 114 traveling in the first direction 116 from flowing into a portion of the passages 432. To this end, each cover plate 404 is coupled to one of the support members 362 to generally enclose a portion (e.g., a base portion) of the U-shaped configuration of each support member 362, thereby blocking the air flow 114 from entering the passages 432 at respective lower portions 438 of the support members 362. The cover plates 404 may have an L-shaped configuration, as in the illustrated embodiment. For example, a first extension 440 of each cover plate 404 may be coupled to and extend along one of the inner walls 430 of the support members 362, and a second extension 442 of each cover plate 404 may extend from the corresponding first extension 440 and may enclose at least a portion of the passage 432 of the corresponding support member 362. In this way, disturbance or agitation of the captured condensate travelling down the passages 432 caused by the air flow 114 traveling in the first direction 116 is avoided, thereby promoting desirable flow of the captured condensate to the drain pan 220 and to the drain port 326. It should be understood that the shape and size of cover plates 404 may vary and/or may be selected based on a particular configuration of the condensate capture assembly 222 and/or other parameters of the HVAC unit 100.

Figure 9:
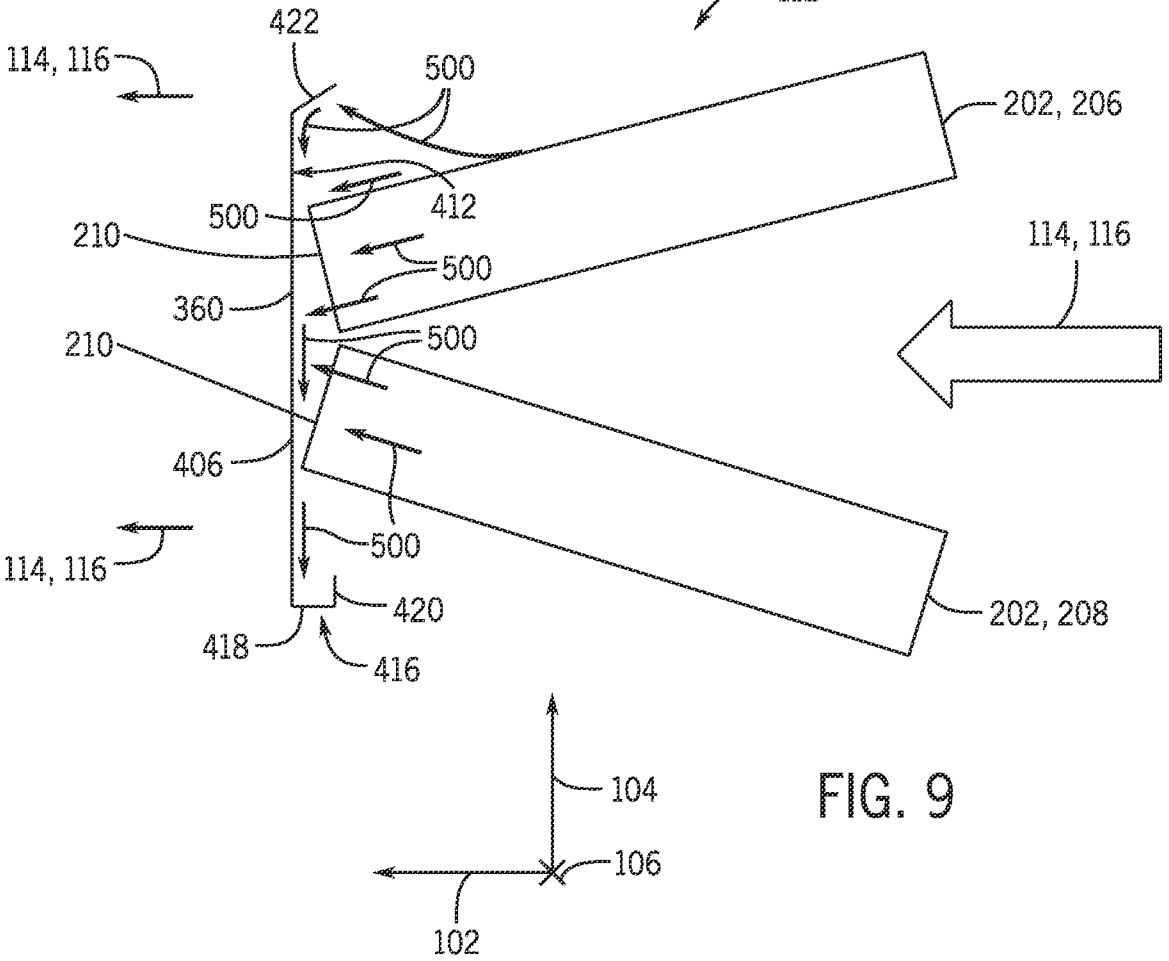
FIG. 9 is a schematic diagram of an embodiment of a condensate collection assembly, illustrating capture of condensate via the condensate collection assembly, in accordance with an aspect of the present disclosure.

FIG. 9 is a cross-sectional schematic view of an embodiment of the heat exchanger 112 and the shield panel 360, illustrating capture of condensate 500 dislodged from the heat exchanger 112 via the air flow 114 traveling in the first direction 116. Specifically, as the air flow 114 flows across and through the coil assemblies 202 in the first direction 116, condensate 500 may be generated as moisture or water vapor within the air flow 114 condenses. In some instances, the condensate 500 may form and/or accumulate on the heat exchange coils 202 (e.g., fins 218). As previously discussed and further illustrated in FIG. 9, the air flow 114 may force the condensate 500 to travel generally in the first direction 116 and/or along the longitudinal axis 102. For example, the condensate 500 may travel along the fins 218 of the heat exchange coils 202. Some condensate 500 may ultimately reach one or more downstream ends 210 of the heat exchange coils 202 and may be dislodged from the heat exchange coils 202. The force of the air flow 114 may carry the condensate 500 from the heat exchange coils 202. Subsequently, as shown in the illustrated embodiment, the condensate 500 carried by the air flow 114 may contact the condensate capture surface 412 and may then travel downwardly toward the channel 416 of the shield panel 360.

In some embodiments, the shield panel 360 may be formed from a material that is generally or substantially impervious to water or liquid, but enables transmission of at least a portion of the air flow 114 therethrough. In another embodiment, the shield panel 360 may be formed from a material that blocks flow of both liquid and gas therethrough. In any case, the condensate 500 that impinges against the condensate capture surface 412 is diverted downwards, due to gravity, along the height 410 of the main body 406 towards the channel 416. In addition, some condensate 500 may be blown at least partially upwards along the vertical axis 104 (e.g., due to turbulence or the air flow 114), but such condensate 500 may be captured and/or diverted by the flange 422 of the shield panel 360 and diverted to the channel 416 in the manner described above.

As set forth above, embodiments of the present disclosure may provide one or more technical effects useful for efficiently capturing and/or collecting condensate that forms and/or accumulates on a heat exchanger and is dislodged from the heat exchanger by an air flow directed across the heat exchanger (e.g., in a generally horizontal direction). In particular, the condensate collection assembly discussed herein is configured to capture condensate, including condensate blowoff, that may be generated during operation of the heat exchanger, as well as provide structural support for the heat exchanger in an HVAC unit. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A condensate collection assembly, comprising:

a drain pan configured to collect condensate generated by a heat exchanger of a heating, ventilation, and air conditioning (HVAC) system;

a support member configured to couple to the drain pan and extend from the drain pan; and a shield panel configured to couple to the support member and overlap with the heat exchanger relative to a direction of air flow across the heat exchanger, wherein the shield panel comprises a first edge and a second edge opposite the first edge, the support member is configured to extend from the first edge of the shield panel to the second edge of the shield panel and the support member defines a passage that extends from the shield panel to a draining surface of the drain pan.

2. The condensate collection assembly of claim 1, wherein the support member is a first support member, the condensate collection assembly comprises a second support member configured to couple to the drain pan and extend from the drain pan, and the shield panel is configured to couple to the second support member.

3. The condensate collection assembly of claim 2, wherein the shield panel is configured to extend from the first support member to the second support member and across an air flow path of the air flow.

4. The condensate collection assembly of claim 2, wherein the shield panel is configured to couple to the heat exchanger and support the heat exchanger within the drain pan via the first support member and the second support member.

5. The condensate collection assembly of claim 2, wherein the shield panel defines a channel formed at the second edge of the shield panel, and the channel is configured to direct condensate captured by the shield panel toward the drain pan.

6. The condensate collection assembly of claim 5, wherein the drain pan comprises a plurality of side walls that defines a basin configured to collect condensate generated by the heat exchanger, the first support member is coupled to a first side wall of the plurality of side walls, the second support member is coupled to a second side wall of the plurality of side walls, and the first side wall is opposite the second side wall.

7. The condensate collection assembly of claim 6, wherein the passage is a first passage extending along the first support member, the second support member defines a second passage extending along the second support member from the shield panel to the draining surface of the drain pan, and the channel is configured to direct condensate captured by the shield panel to the first passage and the second passage.

8. The condensate collection assembly of claim 7, wherein the first passage and the second passage are configured to direct condensate into the basin of the drain pan.

9. The condensate collection assembly of claim 8, comprising a first cover plate configured to couple to the first support member and enclose at least a portion of the first passage to block air flow into the portion of the first passage.

10. The condensate collection assembly of claim 1, wherein the support member comprises a first wall and a second wall, the first wall is configured to extend from the first edge of the shield panel to the second edge of the shield panel, the first wall is configured to overlap and couple to the shield panel, the second wall extends transversely from the first wall, and the second wall is configured to extend along a lateral side of the heat exchanger.

11. A condensate collection assembly, comprising:

a drain pan configured to collect condensate generated by a heat exchanger disposed within an air flow path of a heating, ventilation, and air conditioning (HVAC) system, wherein the drain pan comprises a base and a plurality of walls extending from the base and defining an outer perimeter of the drain pan; and a condensate capture assembly, comprising:

a support member configured to couple to a first wall of the plurality of walls of the drain pan within the outer perimeter of the drain pan; and a condensate barrier comprising a first edge and a second edge opposite the first edge, wherein the condensate barrier is configured to couple to the support member, such that the condensate barrier is disposed within the air flow path and is offset from the drain pan, and the support member is configured to extend from the first edge of the condensate barrier to the second edge of the condensate barrier.

12. The condensate collection assembly of claim 11, wherein the condensate barrier is configured to overlap with the heat exchanger relative to a direction of air flow along the air flow path.

13. The condensate collection assembly of claim 11, wherein the support member is a first support member, the condensate capture assembly comprises a second support member configured to couple to a second wall of the plurality of walls of the drain pan, and the first support member and the second support member are configured to direct the condensate from the condensate barrier to the base of the drain pan.

14. The condensate collection assembly of claim 13, wherein the first wall is opposite the second wall.

15. The condensate collection assembly of claim 11, wherein the condensate barrier comprises a main body and a channel integrally formed along the first edge of the main body, wherein the channel is configured to capture condensate diverted by the main body and direct the condensate toward the drain pan.

16. The condensate collection assembly of claim 15, wherein the condensate barrier comprises a flange extending from the second edge of the main body, opposite the first edge.

17. The condensate collection assembly of claim 11, wherein the condensate capture assembly comprises at least one bracket configured to secure the condensate barrier, the support member, or both to the heat exchanger.

18. A heating, ventilation, and air conditioning (HVAC) system, comprising:

a heat exchanger disposed within an air flow path and configured to condition an air flow directed across the heat exchanger; and a condensate collection assembly configured to capture condensate within the air flow that is generated by the heat exchanger, wherein the condensate collection assembly comprises:

a drain pan disposed beneath the heat exchanger, relative to a vertical axis;

a support member extending from the drain pan; and a shield panel extending across the air flow path, wherein the shield panel comprises a first edge and a second edge opposite the first edge, the shield panel defines a channel integrally formed along the first edge of the shield panel, the shield panel is configured to capture the condensate within the air flow that is generated by the heat exchanger and to direct the condensate via the channel toward the drain pan, the shield panel overlaps with the heat exchanger relative to a direction of the air flow along the air flow path, the shield panel is separate and offset from the drain pan, and the support member extends from the first edge of the shield panel to the second edge of the shield panel.

19. The HVAC system of claim 18, wherein the support member is coupled to the drain pan, the shield panel is coupled to the support member and is disposed at an offset distance from the drain pan, and the support member comprises a passage configured to direct the condensate captured by the shield panel from the channel to a base of the drain pan.

20. The HVAC system of claim 18, wherein the condensate collection assembly is coupled to the heat exchanger, and the condensate collection assembly is configured to at least partially support a weight of the heat exchanger.

* * * * *